US007990281B2

(12) United States Patent
Tylicki et al.

(10) Patent No.: US 7,990,281 B2
(45) Date of Patent: Aug. 2, 2011

(54) APPARATUS AND METHOD PERTAINING TO A DOORBELL CHIME COVER

(75) Inventors: Scott Blaise Tylicki, Bowling Green, KY (US); Timothy Gale Birdwell, Lafayette, TN (US); Thomas Michael Gott, Bowling Green, KY (US); Jimmy David Claiborne, Scottsville, KY (US)

(73) Assignee: HeathCo, LLC, Bowling Green, KY (US)

( * ) Notice: Subject to any disclaimer, the term of this patent is extended or adjusted under 35 U.S.C. 154(b) by 388 days.

(21) Appl. No.: 12/347,044

(22) Filed: Dec. 31, 2008

(65) Prior Publication Data

US 2010/0164696 A1 Jul. 1, 2010

(51) Int. Cl.

| | |
|---|---|
| ***G08B 23/00*** | (2006.01) |
| ***G08B 3/00*** | (2006.01) |
| ***G10K 1/00*** | (2006.01) |

(52) U.S. Cl. ..... 340/693.6; 340/693.5; 340/692; 340/545.6; 340/693.12; 340/384.1; 340/392.5; 340/396.1

(58) Field of Classification Search ..... 340/693.6, 340/392.5

See application file for complete search history.

(56) References Cited

U.S. PATENT DOCUMENTS

| | | | | |
|---|---|---|---|---|
| 5,329,836 | A * | 7/1994 | Stannard | 84/402 |
| 5,764,131 | A * | 6/1998 | Twining et al. | 340/311.2 |
| 6,750,760 | B2 * | 6/2004 | Albritton et al. | 340/392.1 |
| 7,126,490 | B2 | 10/2006 | Cole, Sr. et al. | |
| 2007/0279198 | A1 | 12/2007 | Chen et al. | |

OTHER PUBLICATIONS

Furnace Blower Door Safety Switch as shown on http://www.ecrater.com/product.php?pid=2239870 printed on May 12, 2009.

* cited by examiner

*Primary Examiner* — Donnie L Crosland

(74) *Attorney, Agent, or Firm* — Fitch, Even, Tabin & Flannery

(57) ABSTRACT

A doorbell chime (100) can comprise a chassis (101), a cover (104) having a mechanical-cover identifier (105, 106), a mechanical-cover identifier detector (103) (to detect when the cover is at least substantially disposed in the installed position), and a chime (102) mounted in the chassis. This chime is configured to operate in a first mode of operation (302) when the mechanical-cover identifier detector detects the cover and in a second mode of operation (303) (that is different than the first mode of operation) when the mechanical-cover identifier detector does not detect the cover.

29 Claims, 2 Drawing Sheets

100

APPARATUS AND METHOD PERTAINING TO A DOORBELL CHIME COVER

TECHNICAL FIELD

This invention relates generally to doorbell chimes.

BACKGROUND

Doorbell chimes are well known in the art. Doorbell chimes typically serve to sound an audible alert when a doorbell button located near a door that provides entry to a given facility is asserted by a visitor to that facility. The doorbell button may couple to the doorbell chime itself via a wireless or a non-wireless connection. The audible alert can vary widely, typically ranging from a simple bell sound to short polyphonic musical pieces to speech content (with or without musical accompaniment). These sounds are sometimes provided by a striker system (where one or more percussive instruments are physically struck by one or more strikers) and sometimes by an electronic playback platform.

In some cases, a given doorbell chime only provides a single alert sound. Increasingly, however, consumers have interest in doorbell chimes that offer a variety of available alert sounds. In some cases, this capability serves to permit the user to select a given sound to be set once and then essentially left undisturbed thereafter. In other cases, however, this capability permits the user to change the chime sound from time to time to suit various changing preferences, seasonal themes, special occasions, and so forth. This kind of on-going dynamic use of a given doorbell chime is at least indirectly encouraged by the choice of particular candidate sounds (for example, when a given doorbell chime has sounds comprising snippets of musical pieces that are easily recognizable as Christmas carols, patriotic songs, or songs that are readily identified with various personal and public holidays and other special events and celebratory occasions.

Doorbell chimes typically comprise a chassis that mounts to a wall surface and that supports the actual chime mechanism. A cover then fits on the chassis and provides an aesthetically-pleasing appearance. In many cases involving a multi-sound doorbell chime, such a cover must be removed in order to provide access to a user interface on the chassis that permits a given alert sound to be selected by the user for use at a given time. This, however, can give rise to a corresponding problem—proper replacement of the cover upon completing such a selection process. Doorbell chimes are often located relatively high on an interior wall and improper replacement of the cover can result in the cover falling to the ground and being damaged and/or damaging an object in the path of the falling cover.

Another issue involves the increasing opportunities for an end user to mix-and-match various covers and chassis's. Though such a capability provides benefits in that a user can use any of a variety of covers with a given chassis to accommodate specific aesthetic requirements, this capability also provides an opportunity for mismatching to occur when the user attempts to pair a cover and a chassis that are not designed to operate in tandem with one another. Such a mismatch, in turn, again creates opportunities for mishaps such as the possibility of the cover falling.

Yet another issue involves the acoustic design and performance of the doorbell chime as a system. In many cases (and increasingly so) the cover comprises an important part of the acoustic design of the doorbell chime and can involve, for example, careful impedance matching. Improperly installing the cover, or installing an incorrect cover, can lead to varying degrees of impaired acoustic performance of the doorbell chime.

BRIEF DESCRIPTION OF THE DRAWINGS

The above needs are at least partially met through provision of the apparatus and method pertaining to a doorbell chime cover described in the following detailed description, particularly when studied in conjunction with the drawings, wherein.

Figure 1:
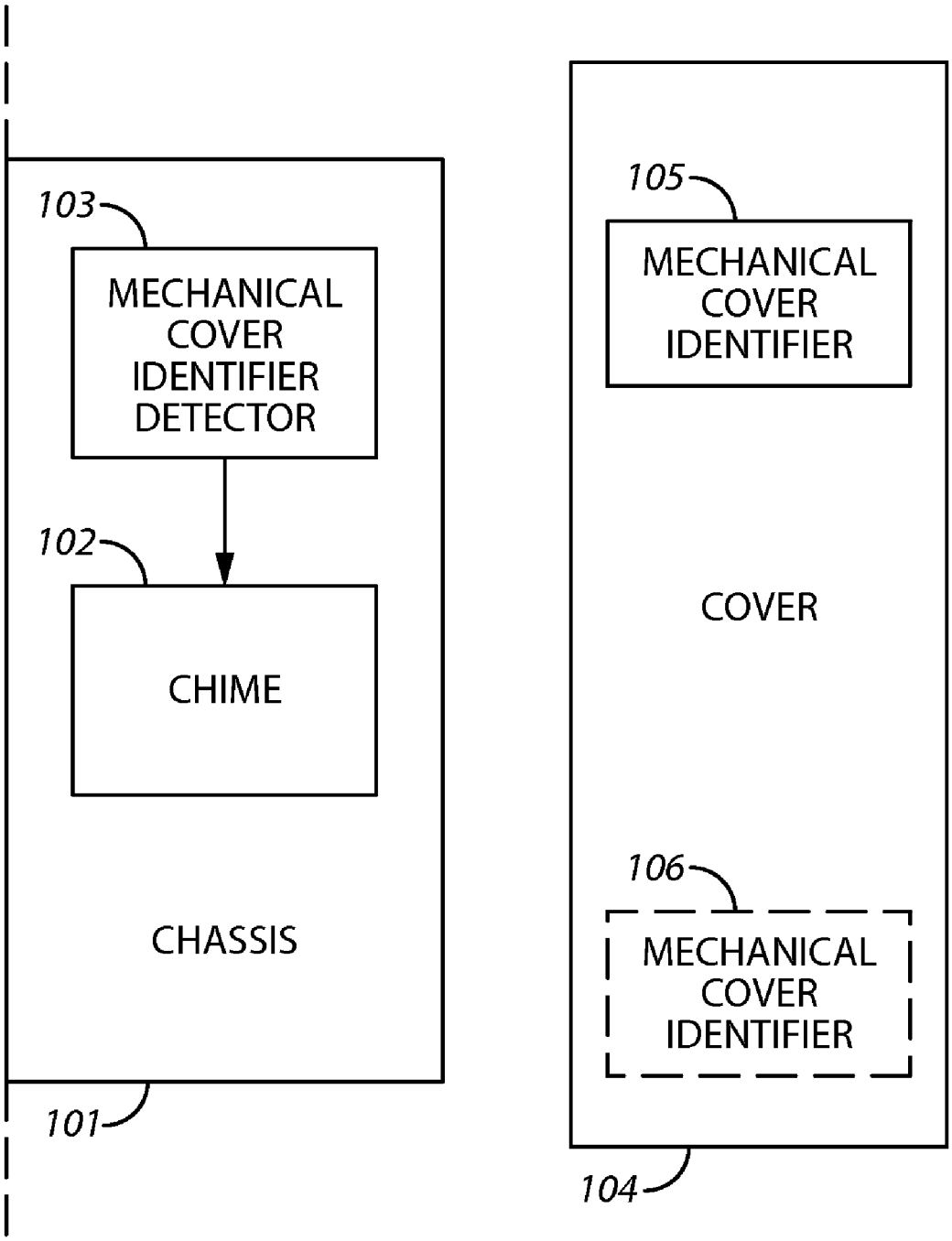
FIG. 1 comprises a block diagram as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a doorbell chime can comprise a chassis, a cover having a mechanical-cover identifier, a mechanical-cover identifier detector (to detect when the cover is at least substantially disposed in the installed position), and a chime mounted in or on the chassis. This chime is configured to operate in a first mode of operation when the mechanical-cover identifier detector detects the cover and in a second mode of operation (that is different than the first mode of operation) when the mechanical-cover identifier detector does not detect the cover.

These teachings will accommodate a wide variety of options in these regards. For example, by one approach, the first mode of operation can comprise sounding a chime when the doorbell interface is asserted by a person while the second mode of operation can comprise not sounding such a chime under such circumstances. By another approach, the second mode of operation can comprise sounding a missing-cover alert. The latter may comprise, for example, a unique corresponding tone, tones, or melody and/or a corresponding verbal statement or a combination thereof.

These teachings will also accommodate a wide variety of approaches with respect to the aforementioned mechanical-cover identifier and the mechanical-cover identifier detector. The mechanical-cover identifier can comprise an integral part of the cover, if desired, and can be as simple as a tab that protrudes outwardly of the cover. Other form factors can be utilized as well as desired including, for example, convoluted and/or otherwise complex key-like elements. This cover identifier can also comprise, if desired, one or more components that are added to the cover.

So configured, multi-sound selectability can be easy supported while also tending to ensure that the cover is properly replaced after making such a selection. In particular, these teachings provide an audibly discernable alert (either by the presence, or the distinct absence, of chime-based audio content) to advise the user when the cover has not been properly replaced. This, in turn, affords the user an opportunity to correctly install the cover and avoid the potential risks of an inappropriately installed cover.

These and other benefits may become clearer upon making a thorough review and study of the following detailed description. Referring now to the drawings, and in particular to FIG. 1, an illustrative doorbell chime 100 that is compatible with many of these teachings will now be presented.

In this example the doorbell chime 100 comprises a chassis 101 that supports a chime 102. This chime 102 can be mounted in the chassis 101 (using, for example, attachment members such as screws, bolts, clips, or the like) and can be configured to sound a chime when the chime is operating in an ordinary mode of operation and when a corresponding doorbell user interface (not shown) is asserted by a person. Those skilled in the art will recognize that there are numerous ways of meeting such a requirement. For example, the chime 102 can comprise a striker-based mechanism having a mechanical striker that makes abrupt contact with one or more objects (such as metal tubes, bells, or the like) to thereby cause the latter to make the desired chime sound.

By another approach, this chime 102 can comprise, in whole or in part, an electronic platform that produces the desired chime sound electronically. Again, those skilled in the art will recognize that there are various ways of achieving this result. The sound can be recalled from memory and played back, the sound can be partially or wholly synthesized, the sound can comprise the playback of MIDI programming, and so forth. Those skilled in the art will recognize and understand that these examples are intended to serve only in an illustrative capacity and are not intended to comprise an exhaustive listing of all possibilities in this regard.

In this illustrative example this chime 102 is also configured to support a second mode of operation that is different from the aforementioned first mode of operation. The specifics of this second mode of operation can vary as desired and more details in this regard will be presented below.

This doorbell chime 100 also comprises a mechanical-cover identifier detector 103 that may or may not comprise a part of the chassis 101 as desired. This mechanical-cover identifier detector 103 is configured to detect a mechanical-cover identifier 105 as comprises a part of a corresponding cover 104 as explained below. By one approach, this mechanical-cover identifier detector 103 is configured to detect this mechanical-cover identifier 105 only when the cover 104 is at least substantially disposed in an installed position with respect to the chassis 101. (The word "substantially" is used here to accommodate the fact that a given physical embodiment will likely exhibit a range of positions (within, say, a small fraction of an inch such as a few hundreds or a tenth or so of an inch) within which the cover can be viewed as being "substantially" installed even if not perfectly and exactly in an installed position.")

The specific nature of the mechanical-cover identifier detector 103 can vary with respect to the corresponding mechanical-cover identifier 105 itself. By one approach, for example, this mechanical-cover identifier detector 103 can comprise an optical mechanism that detects when the mechanical-cover identifier 105 is present. By another approach, this mechanical-cover identifier detector 103 can comprise a properly located electrical switch that becomes closed (or opened) when contacted by the mechanical-cover identifier 105. Those skilled in the art will recognize that other possibilities exist in these regards as well such as magnetically-based detection, the use of radio frequency identification tag (RFID)-based detection, and so forth.

As mentioned above, this doorbell chime 100 also comprises a cover 104 that is configured to cover at least a substantially portion of the chassis 101 when disposed in an installed position. For example, when installed and viewed from the front, the cover 104 may cover and occlude from view 100% of the chassis 101 whereas when viewed from the side the cover 104 may only occlude, say, 50% of the chassis 101 from view. These teachings will of course accommodate completely covering the chassis 101 if desired.

Also as mentioned above, this cover 104 includes a mechanical-cover identifier 105. This mechanical-cover identifier 105 may serve to uniquely identify this particular cover 104 if desired, but will at least serve to identify that the cover 104 is a particular cover that is intended for use with the chassis 101. Generally speaking, if desired, this mechanical-cover identifier 105 can comprise an integral part of the cover 104. This can comprise using, for example, a tab that protrudes away from the cover 104 (such as, for example a member that protrudes generally towards the chassis 101 when the cover 104 is in the installed position).

Figure 2:
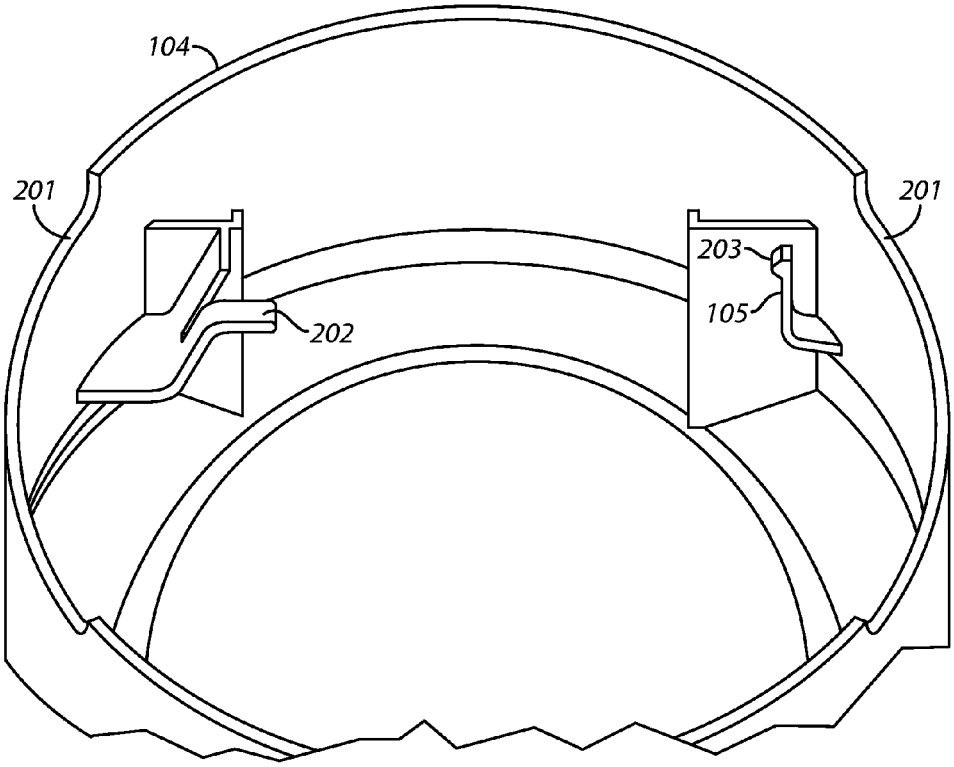
FIG. 2 comprises a perspective detail view as configured in accordance with various embodiments of the invention.

Referring momentarily to FIG. 2, a non-limiting illustrative example will be provided. In this example, the cover 104 comprises a circular-shaped cover having indented areas 201 to accommodate a user's fingers (not shown) to facilitate removing (or installing) the cover 104. This particular example includes two physical features that assist with properly positioning and installing the cover 104 on a corresponding chassis. The first feature comprises a first member 202 that can be located within a corresponding opening in the chassis to aid in properly positioning the cover 104 while allowing some play in movement while completing the installation of the cover 104. The second feature comprises a second member 203 that is a snap-fit feature and that is configured to be disposed within another opening in the chassis. Such snap-fit features are well known in the art and require no further elaboration here.

In this illustrative embodiment, the snap-fit feature 203 also comprises the mechanical-cover identifier 105 for this cover 104. In particular, this snap-fit feature 203 is also designed to contact and engage a corresponding electrical switch (comprising, for example, a press-to-close button that serves as the aforementioned mechanical-cover identifier detector 103) when the cover 104 is properly installed on the chassis. If desired, however, the first member 202 could serve instead as the mechanical-cover identifier. These teachings would also accommodate having both such members serve as a mechanical-cover identifier if desired.

In the examples just provided, the mechanical-cover identifier comprised a part of a member that also served to position and/or retain the cover 104 in an installed position. These teachings will also accommodate, however, alternatives in this regard. For example, the mechanical-cover identifier could readily comprise a pin or post that simply contacts a press-to-close button on the chassis while offering no assistance with respect to positioning or retaining the cover 104 in the installed position.

Referring again to FIG. 1, and to reiterate a point recently made, a given cover 104 can have more than one mechanical-cover identifier if desired. This is suggested in FIG. 1 by the depiction of a second optional mechanical-cover identifier 106. Although only a second such mechanical-cover identifier is shown, those skilled in the art will recognize that any plurality of mechanical-cover identifiers can be employed as desired. It will also be understood that these teachings will accommodate using a plurality of mechanical-cover identifiers that are different from one another with respect to their physical form factor and/or their additional functionality.

So configured, when the cover 104 is disposed other than in a substantially-installed position, the mechanical-cover identifier detector 103 will not detect the cover 104. Conversely, when the cover 104 is disposed in at least a substantially-installed position, the mechanical-cover identifier detector 103 will detect the mechanical-cover identifier 105

Figure 3:
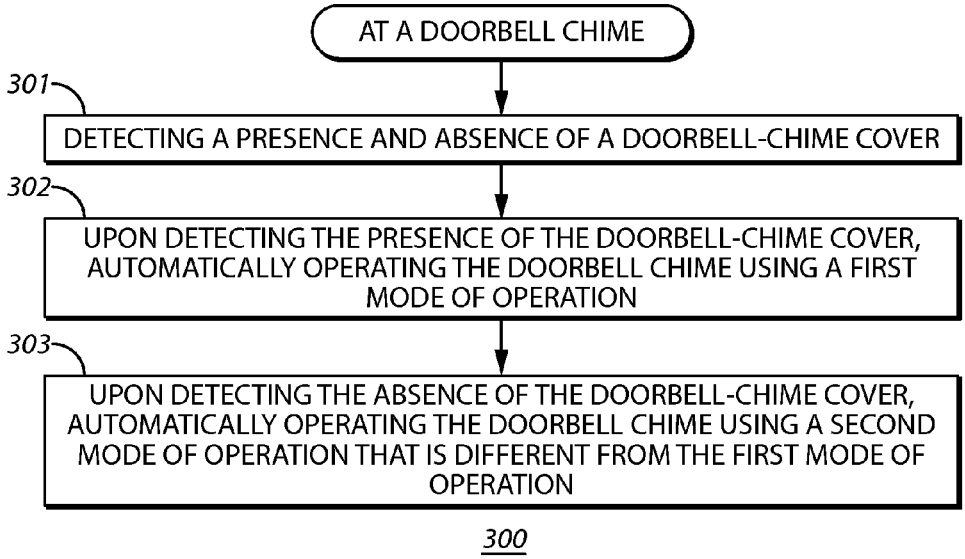
FIG. 3 comprises a flow diagram as configured in accordance with various embodiments of the invention.

An illustrative process 300 that is compatible with many of these teachings will now be presented. Referring to FIG. 3, this process 300 can be carried out in conjunction with a doorbell chime as accords with the foregoing description. These described steps can be carried out, as desired, by a partially or wholly programmable platform or by use of a hard-wired electronic circuit. Those skilled in the art will be well familiar with such approaches and no further description need be provided here in these regards.

This process 300 includes the step 301 of detecting the presence and absence of a doorbell-chime cover. This can comprise, for example, attempting to detect a mechanical-cover identifier as comprises a part of the doorbell-chime cover. This process 300 can then further include the step 302 of, upon detecting the presence of the doorbell-chime cover, automatically operating the doorbell chime using a first mode of operation. This first mode of operation can comprise, for example, a normal mode of operation. A normal mode of operation can comprise sounding a given alert in response to detecting a person's assertion of a doorbell button.

In other words, and to put this most simply, when the cover is properly installed, this doorbell chime operates in an ordinary and regular manner and sounds the expected chime when someone presses the doorbell button.

This process 300 also includes the step 303, however, of, upon detecting the absence of the doorbell-chime cover, automatically operating the doorbell chime using a second mode of operation that is different from the first mode of operation.

As one simple example in this regard, this second mode of operation can comprise not sounding the expected chime (or, indeed, any sound whatsoever) when the corresponding doorbell interface is asserted. By this simple approach, doorbell chime essentially automatically becomes silent when the cover is removed or inappropriate installed. This same result will also occur when the user installs a cover that is not intended for use with this particular chassis. This failure to provide the expected sound will of course be noted by the user and will tend to prompt the user to inspect the doorbell chime. This inspection, in turn, will hopefully lead to a correction of the underlying problem.

As another example in these regards, this second mode of operation can comprise the sounding of a missing-cover alert when the corresponding doorbell interface is asserted by a person. This missing-cover alert can comprise a specific and unique non-verbal sound, tone, or musical offering to denote that the doorbell-chime cover is not properly installed. As another example, this missing-cover alert can comprise a corresponding verbal statement (such as, for example, "Caution, the doorbell chime cover is not properly installed.").

Some doorbell chimes include a plurality of different candidate sounds. A user can select a particular sound to be used when someone asserts the doorbell button. In such a case, these teachings will also accommodate using the aforementioned second mode of operation to facilitate the selection of a particular sound from amongst the candidate sounds. For example, when the cover is removed, the doorbell chime can automatically and responsively enter a test mode of operation pursuant to which the chime automatically sounds candidate chimes from amongst the plurality of available candidate chimes. The user can then select a particular chime to be used during the first mode of operation as the doorbell chime sound.

For example, by one approach, upon removing the cover the doorbell chime can automatically begin cycling through the available chime sounds. When the user hears the desired sound, the user can then replace the cover in its installed position to return the doorbell chime to its ordinary state of operation (using the selected chime sound). As another approach, upon removing the cover, the doorbell chime can automatically cycle through the available chime sounds with each assertion of a signal. This can be achieved by asserting the doorbell button to provide such a signal. This can also be achieved by asserting a dedicated button provided for this purpose on the chassis.

So configured, these teachings provide a simple and effective way of indicating to an end user that a doorbell-chime cover is not properly installed. This, in turn, can assist in avoiding future operational problems and/or potential damage to the cover or property with in the vicinity of the doorbell chime. These teachings are highly flexible and can be readily employed to leverage the capabilities of various existing doorbell chime designs. It will further be appreciated that these teachings are very scalable and can be employed with a variety of doorbell chimes ranging from simple platforms to more sophisticated and complex platforms that provide numerous features and capabilities.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in these regards, the mechanical-cover identifier can comprise, if desired, a screw or other like attachment member that also serves the purpose of assisting with attaching the cover to the chassis.

We claim:

1. A doorbell chime comprising:

a chassis;

a cover configured to cover at least a substantial portion of the chassis when disposed in an installed position and comprising a mechanical-cover identifier;

a mechanical-cover identifier detector configured to detect the mechanical-cover identifier only when the cover is at least substantially disposed in the installed position;

a chime mounted in the chassis and being operably coupled to the mechanical-cover identifier detector, wherein the chime is configured to operate in a first mode of operation when the mechanical-cover identifier detector detects the cover and in a second mode of operation that is different than the first mode of operation when the mechanical-cover identifier detector does not detect the cover.

2. The doorbell chime of claim 1 wherein the mechanical-cover identifier comprises a part of a snap-fit feature.

3. The doorbell chime of claim 1 wherein the mechanical-cover identifier comprises an integral part of the cover.

4. The doorbell chime of claim 1 wherein the mechanical-cover identifier protrudes from the cover.

5. The doorbell chime of claim 4 wherein the mechanical-cover identifier protrudes generally towards the chassis when the cover is in the installed position.

6. The doorbell chime of claim 1 wherein the cover comprises a plurality of mechanical-cover identifiers.

7. The doorbell chime of claim 6 wherein the mechanical-cover identifier detector is configured to detect all of the mechanical-cover identifiers only when the cover is at least substantially disposed in the installed position.

8. The doorbell chime of claim 7 wherein the chime is further configured to operate in the first mode of operation only when all of the plurality of mechanical-cover identifiers detect the cover.

9. The doorbell chime of claim 1 wherein:

the first mode of operation comprises an ordinary mode of operation pursuant to which the chime sounds a chime when a corresponding doorbell user interface is asserted by a person;

the second mode of operation comprises a suspended mode of operation pursuant to which the chime does not sound a chime when the corresponding doorbell interface is asserted by a person.

10. The doorbell chime of claim 1 wherein:

the second mode of operation includes automatically enabling a sound-selection state to select the first mode of operation's chime sound from amongst a plurality of candidate sounds.

11. The doorbell chime of claim 1 wherein:

the first mode of operation comprises an ordinary mode of operation pursuant to which the chime sounds a chime when a corresponding doorbell user interface is asserted by a person;

the second mode of operation comprises a mode of operation pursuant to which the chime sounds a missing-cover alert when the corresponding doorbell interface is asserted by a person.

12. The doorbell chime of claim 11 wherein the missing-cover alert comprises a corresponding verbal statement.

13. The doorbell chime of claim 11 wherein the second mode of operation comprises sounding the missing-cover alert in addition to sounding the chime when the corresponding doorbell interface is asserted by a person.

14. The doorbell chime of claim 1 wherein:

the first mode of operation comprises an ordinary mode of operation pursuant to which the chime sounds a chime as has been previously selected by an end user when a corresponding doorbell user interface is asserted by a person;

the second mode of operation comprises an altered mode of operation pursuant to which the chime automatically sounds a candidate chime, from amongst a plurality of available candidate chimes, when the corresponding doorbell interface is asserted by a person.

15. The doorbell chime of claim 1 wherein the first mode of operation comprises an ordinary mode of operation pursuant to which the chime sounds a chime as has been previously selected by an end user during the second mode of operation when a corresponding doorbell user interface is asserted by a person;

the second mode of operation comprises a test mode of operation pursuant to which the chime automatically sounds candidate chimes, from amongst a plurality of available candidate chimes, from which a user can select a particular chime to be used during the first mode of operation as the doorbell chime.

16. A doorbell-chime cover for use with a doorbell chime having a chassis, a mechanical-cover identifier detector configured to detect a mechanical-cover identifier only when the cover is at least substantially disposed in an installed position with respect to the chassis, and an electronic chime mounted in the chassis and being operably coupled to the mechanical-cover identifier detector, wherein the electronic chime is configured to operate in a first normal mode of operation when the mechanical-cover identifier detector detects the cover and in a second mode of operation that is different than the first mode of operation when the mechanical-cover identifier detector does not detect the cover, the doorbell chime cover comprising:

a cover configured to cover at least a substantial portion of the chassis when disposed in an installed position;

a mechanical-cover identifier having a shape and being disposed so as to be detectable by the mechanical-cover identifier detector when the doorbell chime cover is disposed in the installed position;

such that the doorbell chime will operate differently depending upon whether the doorbell-chime cover is disposed in the installed position.

17. The doorbell-chime cover of claim 16 wherein the mechanical-cover identifier comprises an integral part of the cover.

18. The doorbell-chime cover of claim 17 wherein the mechanical-cover identifier protrudes from the cover.

19. The doorbell-chime cover of claim 16 wherein the mechanical-cover identifier comprises a plurality of mechanical-cover identifiers.

20. The doorbell-chime cover of claim 19 wherein the plurality of mechanical-cover identifiers are integral to the cover.

21. The doorbell-chime cover of claim 16 wherein the mechanical-cover identifier comprises a part of a snap-fit assembly that is configured to operate in conjunction with the chassis.

22. A method comprising:

at a doorbell chime:

detecting a presence and absence of a doorbell-chime cover;

upon detecting the presence of the doorbell-chime cover, automatically operating the doorbell chime using a first mode of operation;

upon detecting the absence of the doorbell-chime cover, automatically operating the doorbell chime using a second mode of operation that is different from the first mode of operation.

23. The method of claim 22 wherein detecting a presence and absence of a doorbell-chime cover comprises, at least in part, attempting to detect a mechanical-cover identifier as comprises a part of the doorbell-chime cover.

24. The method of claim 22 wherein the first mode of operation comprises a normal mode of operation.

25. The method of claim 24 wherein the second mode of operation comprises a chime-selection mode of operation to facilitate a user's selection of a particular chime to be used, from amongst a plurality of available candidate chimes, during the normal mode of operation.

26. The method of claim 24 wherein the second mode of operation comprises an alert mode of operation to alert a user that the doorbell-chime cover is not properly installed on the doorbell chime.

27. The method of claim 26 wherein the alert mode of operation comprises providing an audible verbal alert.

28. The method of claim 27 wherein the audible verbal alert comprises verbal content specifically indicating that the doorbell-chime cover is not properly installed.

29. The method of claim 26 wherein the alert mode of operation comprises providing, at least in part, a non-verbal sound that is not used by the doorbell chime for any other purpose.

* * * * *